US005750478A

United States Patent [19]

Kim et al.

[11] Patent Number: 5,750,478

[45] Date of Patent: May 12, 1998

[54] HIGH LOAD-CARRYING TURBO OILS CONTAINING AMINE PHOSPHATE AND SULFURIZED FATTY ACID

[75] Inventors: Jeenok T. Kim, Holmdel; Paul Joseph Berlowitz, East Windsor; Manuel A. Francisco, Washington; Morton Beltzer, Westfield, all of N.J.

[73] Assignee: Exxon Research and Engineering Company, Florham Park, N.J.

[21] Appl. No.: 808,101

[22] Filed: Feb. 28, 1997

Related U.S. Application Data

[63] Continuation of Ser. No. 577,784, Dec. 22, 1995, abandoned.

[51] Int. Cl.[6] ..... C10M 141/06; C10M 141/08

[52] U.S. Cl. ..... 508/331; 508/437

[58] Field of Search ..... 508/331, 437

[56] References Cited

U.S. PATENT DOCUMENTS

| | | | |
|---|---|---|---|
| 2,839,468 | 6/1958 | Stewart et al. | 252/32.5 |
| 3,694,382 | 9/1972 | Kleiman | 252/56 S |
| 3,720,612 | 3/1973 | Bosniack et al. | 252/32.5 |
| 3,859,218 | 1/1975 | Jervis et al. | 252/32.5 |
| 4,049,563 | 9/1977 | Burrous | 252/49.9 |
| 4,116,877 | 9/1978 | Outten et al. | 252/49.8 |
| 4,119,550 | 10/1978 | Davis et al. | 252/45 |
| 4,130,494 | 12/1978 | Shaub et al. | 252/32.5 |
| 4,536,308 | 8/1985 | Pehler et al. | 252/49.9 |
| 4,648,985 | 3/1987 | Thorsell et al. | 252/32.5 |
| 4,780,229 | 10/1988 | Mullin | 252/32.5 |
| 4,826,633 | 5/1989 | Carr et al. | 252/56 S |
| 5,236,610 | 8/1993 | Perez et al. | 252/56 S |

FOREIGN PATENT DOCUMENTS

| | | | |
|---|---|---|---|
| 0434464 | 6/1991 | European Pat. Off. . | |
| 0434464A1 | 6/1991 | European Pat. Off. | C10M 141/08 |
| 1287647 | 8/1969 | United Kingdom . | |
| 1287647 | 9/1972 | United Kingdom | C10M 3/40 |
| 0010270 | 11/1994 | WIPO . | |
| 94/10270 | 5/1995 | WIPO | C10M 141/06 |

*Primary Examiner*—Margaret Medley
*Attorney, Agent, or Firm*—Joseph J. Allocca

[57] ABSTRACT

This invention relates to synthetic based turbo oils, preferably polyol ester-based turbo oils which exhibit exceptional load-carrying capacity by use of a synergistic combination of sulfur (S)-based and phosphorous (P)-based load additives. The S-containing additive of the present invention is sulfurized fatty acid (SFA), preferably the sulfurized oleic acid (SOA) and the P-containing additive is one or more amine phosphate(s). The turbo oil composition consisting of the dual P/S additives of the present invention achieves an excellent load-carrying capacity, which is better than or equivalent to that obtained when each additive was used alone at a treat rate higher than the total additive combination treat rate, and this lower additive concentration requirement allows the turbo oil composition to meet or exceed U.S. Navy MIL-L-23699 requirements including Oxidation and Corrosion Stability and Si seal compatibility.

11 Claims, No Drawings

HIGH LOAD-CARRYING TURBO OILS CONTAINING AMINE PHOSPHATE AND SULFURIZED FATTY ACID

This is a continuation of application Ser. No. 577,784, filed Dec. 22, 1995 now abandoned.

BACKGROUND OF THE INVENTION

1. Field of the Invention

This invention relates to synthetic oil based, preferably polyol ester-based turbo oils which use a synergistic combination of phosphorous (P)- and sulfur (S)-based load additive chemistries which allows the turbo oil formulation to impart high load-carrying capacity and also to meet or exceed U.S. Navy MIL-L-23699 requirements including Oxidation and Corrosion Stability and Si seal compatibility.

Load additives protect metal surfaces of gears and bearings against uncontrollable wear and welding as moving parts are heavily loaded or subjected to high temperatures. Incorporating high load-carrying capacity into a premium quality turbo oil without adversely impacting other properties can significantly increase the service life and reliability of the turbine engines.

The mechanism by which load additives function entails an initial molecular adsorption on metal surfaces followed by a chemical reaction with the metal to form a sacrificial barrier exhibiting reduced friction between the rubbing metal surfaces. In the viewpoint of this action, the effectiveness as load-carrying agent is determined by the surface activity imparted by a polar functionality of a load additive and its chemical reactivity toward the metal; these features can lead to a severe corrosion if not controlled until extreme pressure conditions prevail. As a result, the most of effective load additives carry deleterious side effects on other key turbo oil performances: e.g., corrosion, increased deposit forming tendency and elastomer incompatibility.

2. Description of the Prior Art

British Patent 1,287,647 discloses load additive composition for synthetic ester-based gas turbine engine lubricants. The load-bearing additive composition consists of one or more of phosphorous derivatives which are branched chain alkyl phosphonates and/or halogenated alkyl phosphate, sulfurized oleic acid, and sebacic acid.

WO 94/10270 (PCT/GB 93/02218) discloses a corrosion inhibiting lubricating composition comprising of a synthetic ester base stock; at least one aromatic amine antioxidant; a neutral organic phosphate; a saturated or unsaturated dicarboxylic acid; a straight or branched chain saturated or unsaturated monocarboxylic acid which is optionally sulfurized or an ester of such an acid; and a triazole derivative.

U.S. Pat. No. 4,119,550-A teaches sulfurized composition prepared from olefin, sulfur, and hydrogen sulfide to be useful as extreme pressure and antioxidant lubricant additive. The preferred olefins are aliphatic hydrocarbon, especially (di)isobutene.

EP 434,464 is directed to lube composition or additive concentrate comprising metal-free antiwear and load-carrying additives containing sulfur and/or phosphorous and an amino-succinate ester corrosion inhibitor. The antiwear and load additives include mono- or di-hydrocarbyl phosphate or phosphite with the alkyl radical containing up to $C_{12}$, or an amine salt of such a compound, or a mixture of these; or mono- or dihydrocarbyl thiophosphate where the hydrocarbon (HC) radical is aryl, alkylaryl, arylalkyl or alkyl, or an amine salt thereof; or trihydrocarbyl dithiophosphate in which each HC radical is aromatic, alkyl aromatic, or aliphatic; or amine salt of phosphorothioic acid; optionally with a dialkyl polysulfide and/or a sulfurized fatty acid ester.

U.S. Pat. No. 4,130,494 discloses a synthetic ester lubricant composition containing ammonium phosphate ester and ammonium organo-sulfonate, especially useful as aircraft turbine lubricants. The afore-mentioned lubricant composition have good extreme pressure properties and good compatibility with silicone elastomers.

U.S. Pat. No. 3,859,218 is directed to high pressure lube composition comprising a major portion of synthetic ester and a minor portion of load-bearing additive. The load-carrying additive package contains a mixture of a quaternary ammonium salt of mono-($C_1$–$C_4$) alkyl dihydrogen phosphate and a quaternary ammonium salt of di-($C_1$–$C_4$) alkyl monohydrogen phosphate. In addition to the improved high pressure and wear resistance, the lubricant provides better corrosion resistance and cause less swelling of silicone rubbers than known oils containing amine salts of phosphoric and thiophosphoric acids.

DETAILED DESCRIPTION

A turbo oil having unexpectedly superior load-carrying capacity comprises a major portion of a synthetic base oil selected from diesters and polyol ester base oil, preferably polyol ester base oil, and minor portion of a load additive package comprising a mixture of amine phosphate and sulfurized fatty acid (SFA).

The diester, which can be used in the high load-carrying lube composition of the present invention is formed by esterification of linear or branched $C_6$ to $C_{15}$ aliphatic alcohol with one of such dibasic acids as sebacic, adipic, azelaic acids. Examples of diester are di-2-ethyhexyl sebacate, di-octyl adipate.

The preferred synthetic base stock which is synthetic polyol ester base oil is formed by the esterification of an aliphatic polyol with carboxylic acid. The aliphatic polyol contains from 4 to 15 carbon atoms and has from 2 to 8 esterifiable hydroxyl groups. Examples of polyol are trimethylolpropane, pentaerythritol, dipentaerythritol, neopentyl glycol, tripentaerythritol and mixtures thereof.

The carboxylic acid reactant used to produce the synthetic polyol ester base oil is selected from aliphatic monocarboxylic acid or a mixture of aliphatic monocarboxylic acid and aliphatic dicarboxylic acid. The carboxylic acid contains from 4 to 12 carbon atoms and includes the straight and branched chain aliphatic acids, and mixtures of monocarboxylic acids may be used.

The preferred polyol ester base oil is one prepared from technical pentaerythritol and a mixture of $C_4$–$C_{12}$ carboxylic acids. Technical pentaerythritol is a mixture which includes about 85 to 92% monopentaerythritol and 8 to 15% dipentaerythritol. A typical commercial technical pentaerythritol contains about 88% monopentaerythritol having the structural formula

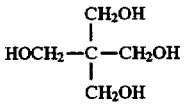

and about 12% of dipentaerythritol having the structural formula

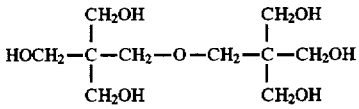

The technical pentaerythritol may also contain some tri and tetra pentaerythritol that is normally formed as by-products during the manufacture of technical pentaerythritol.

The preparation of esters from alcohols and carboxylic acids can be accomplished using conventional methods and techniques known and familiar to those skilled in the art. In general, technical pentaerythritol is heated with the desired carboxylic acid mixture optionally in the presence of a catalyst. Generally, a slight excess of acid is employed to force the reaction to completion. Water is removed during the reaction and any excess acid is then stripped from the reaction mixture. The esters of technical pentaerythritol may be used without further purification or may be further purified using conventional techniques such as distillation.

For the purposes of this specification and the following claims, the term "technical pentaerythritol ester" is understood as meaning the polyol ester base oil prepared from technical pentaerythritol and a mixture of $C_4$–$C_{12}$ carboxylic acids.

As previously stated, to the synthetic oil base stock is added a minor portion of an additive comprising a mixture of amine phosphate and SFA.

The amine phosphate used includes commercial amine phosphate containing mixed mono- and di-acid phosphates and specialty amine salt of diacid phosphate. The mono- and di-acid phosphate amines have the structural formula:

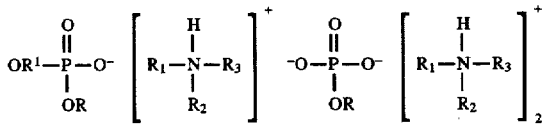

where

R and $R^1$ are the same or different and are $C_1$ to $C_{12}$ linear or branched chain alkyl $R_1$ and $R_2$ are H or $C_1$ to $C_{12}$ linear or branched chain alkyl $R_3$ is $C_4$ to $C_{12}$ linear or branched chain alkyl, or aryl-$R_4$ or $R_4$-aryl where $R_4$ is H or $C_1$–$C_{12}$ alkyl, and aryl is $C_6$.

The preferred amine phosphates are those wherein R and $R^1$ are $C_1$–$C_6$ alkyl, and $R_1$ and $R_2$ are H, or $C_1$–$C_4$ alkyl and $R_3$ is aryl-$R_4$ where $R_4$ is linear chain $C_4$–$C_{12}$ alkyl or $R_3$ is linear or branched chain $C_8$–$C_{12}$ alkyl.

The molar ratio of monoacid to diacid phosphate in the commercial amine phosphates used in this invention ranges from 3:1 to 1:3.

Mixed mono-/di-acid phosphate and just diacid phosphate can be used with the latter being the preferred.

The amine phosphates are used in an amount by weight in the range 50 to 300 ppm (based on base stock), preferably 75 to 250 ppm, most preferably 100 to 200 ppm amine phospate.

Materials of this type are available commercially from a number of sources including R. T. Vanderbilt (Vanlube series) and Ciba Geigy.

SFA, the sulfur containing additive used in this invention, are linear $C_{14}$–$C_{18}$ saturated or unsaturated chain monocarboxylic acids which are cross-linked by S in the forms of mono-, di- and poly-sulfides. The relative fraction of the different S bridges depends on reaction conditions and the relative amount of S charged. The details of sulfurization of fatty acids are found in several references such as *Organic Sulfur Compounds* by L. Bateman and C. G. Moore, and *Mechanism of Sulfur Reaction* by W. A. Pryor.

The preferred SFA is sulfurized oleic acid (SOA) with sulfur concentration of 5 to 15% of the SOA weight, incorporated as the mono- and di-sulfides.

The SFA is used in an amount by weight in the range 100 to 1000 ppm (based on polyol ester base stock), preferably 150 to 800 ppm, most preferably 250 to 500 ppm.

The amine phosphate and the SFA are used in the weight ratio of 1:1 to 1:10, preferably 1:1.5 to 1:5, most preferably 1:2 to 1:3 amine phosphate:SFA.

The synthetic oil based, preferably polyol ester-based high load-carrying oil may also contain one or more of the following classes of additives: antioxidants, antifoamants, antiwear agents, corrosion inhibitors, hydrolytic stabilizers, metal deactivator, detergents. Total amount of such other additives can be in the range 0.5 to 15 wt %, preferably 2 to 10 wt %, most preferably 3 to 8 wt %.

Antioxidants which can be used include aryl amines, e.g., phenylnaphthylamines and dialkyl diphenyl amines and mixtures thereof, hindered phenols, phenothiazines, and their derivatives.

The antioxidants are typically used in an amount in the range 1 to 5%.

Antiwear additives include hydrocarbyl phosphate esters, particularly trihydrocarbyl phosphate esters in which the hydrocarbyl radical is an aryl or alkaryl radical or mixture thereof. Particular antiwear additives include tricresyl phosphate, t-butyl phenyl phosphates, trixylenyl phosphate, and mixtures thereof.

The antiwear additives are typically used in an amount in the range 0.5 to 4 wt %, preferably 1 to 3 wt %.

Corrosion inhibitors include, but are not limited to, various triazols, e.g., tolyl triazol, 1,2,4-benzene triazol, 1,2,3-benzene triazol, carboxy benzotriazole, alkylated benzotriazol and organic diacids, e.g., sebacic acid.

The corrosion inhibitors can be used in an amount in the range 0.02 to 0.5 wt %, preferably 0.05% to 0.25 wt %.

Lubricating oil additives are described generally in "Lubricants and Related Products" by Dieter Klamann, Verlag Chemie, Deerfield, Fla., 1984, and also in "Lubricant Additives"[by C. V. Smalheer and R. Kennedy Smith, 1967, pages 1–11, the disclosures of which are incorporated herein by reference.

The turbo oils of the present invention exhibit excellent load-carrying capacity as demonstrated by the severe FZG gear and 4 Ball tests, while meeting or exceeding the Oxidation and Corrosion Stability (OCS) and Si seal compatibility requirements set out by the United States Navy in MIL-L-23699 Specification. The polyol ester-based turbo oils to which have been added a synergistic mixture of the amine phosphate and the SFA produce a significant improvement in antiscuffing protection of heavily loaded gears/balls over that of the same formulations in the absence of the amine phosphate and the SFA, and furthermore, attain the high load capability better than or equivalent to that achieved with one of these two additives used alone at a weight % greater than the total combination additive treat rate.

The present invention is further described by reference to the following non-limiting examples.

EXPERIMENTAL

In the following examples, a series of fully formulated aviation turbo oils were used to illustrate the performance benefits of using a mixture of the amine phosphate and SFA in the load-canying, OCS and Si seal tests. A polyol ester base stock prepared by reacting technical pentaerythritol with a mixture $C_5$ to $C_{10}$ acids was employed along with a standard additive package containing from 1.7–2.5% by weight aryl amine antioxidants, 0.5–2% tri-aryl phosphates, and 0.1% benzo or alkyl-benzotriazole. To this was added various load-carrying additive package which consisted of the following:

1) Amine phosphate alone: Vanlube 692, a mixed mono/diacid phosphate amine, sold commercially by R. T. Vanderbilt.
2) SOA alone: this particular SFA consists primarily of $C_{18}$ oleic acid cross-linked by 10% S by the weight of SOA.
3) Combination (present invention): the combination of the two materials described in (1) and (2).

The load-carrying capacity of these oils was evaluated in 4 Ball and severe FZG gear tests. The 4 Ball performance is reported in terms of initial seizure load (ISL) defined as the average of maximum passing and minimum failing loads obtained when the load is increased at an increment of 5 kg. The failure criterion is the scuffing/wear scar diameter on a ball to exceed 1 mm at the end of 1 minute run at room temperature under 1500 rpm. The FZG gear test is an industry standard test to measure the ability of an oil to prevent scuffing of a set of moving gears as the load applied to the gears is increased. The "severe" FZG test mentioned here is distinguished from the FZG test standardized in DIN 51 354 for gear oils in that the test oil is heated to a higher temperature (140 versus 90° C.), and the maximum pitch line velocity of the gear is also higher (16.6 versus 8.3 m/s). The FZG performance is reported in terms of FLS, which is defined by a lowest load stage at which the sum of widths of all damaged areas exceeds one tooth width of the gear. Table 1 lists Hertz load and total work transmitted by the test gears at different load stages.

TABLE 1

| Load Stage | Hertz Load (N/mm$^2$) | Total Work (kWh) |
|---|---|---|
| 1 | 146 | 0.19 |
| 2 | 295 | 0.97 |
| 3 | 474 | 2.96 |
| 4 | 621 | 6.43 |
| 5 | 773 | 11.8 |
| 6 | 927 | 19.5 |
| 7 | 1080 | 29.9 |
| 8 | 1232 | 43.5 |
| 9 | 1386 | 60.8 |
| 10 | 1538 | 82.0 |

The OCS [FED-STD-791; Method 5308 @ 400° F.] and Si seal [FED-STD-791; Method 3433] tests used here to evaluate the turbo oils were run under conditions as required by the Navy MIL-L-23699 specification.

The results from the severe FZG and 4 Ball, Si seal and OCS tests are shown in Tables 2, 3 and 4, respectively. The wt % concentrations (based on the polyol ester base stock) of the amine phosphate and SOA, either used alone or in combination are also specified in the tables. Table 2 demonstrates that the combination of the amine phosphate and the SOA exhibits an excellent load-carrying capacity, which is better than or equivalent to that attributed to each additive used alone at a treat rate higher than the total P/S additive combination treat rate. This lower additive treat rate required to attain the high load capability allows the turbo oil formulation of the present invention to meet or exceed the MIL-L-23699 OCS and Si seal specifications whereas 0.1% VL 692-containing formulation fails the Si seal test (see Table 4).

TABLE 2

| Load Additives | Severe FZG FLS | 4 Ball ISL, Kg |
|---|---|---|
| None | 4 | 82 |
| 0.02 wt % Vanlube 692 (VL 692) | 5 | 92 |
| 0.05 wt % SOA | 7 | 87 |
| 0.10 wt % SOA | NA | 92 |
| 0.10 wt % VL 692 | 7 or 8 | 95 |
| 0.05 wt % SOA + 0.02% VL 692 | 8 | 107 |

TABLE 3

| | MIL-23699-OCS Test @ 400° F. | | | | |
|---|---|---|---|---|---|
| Load Additives | % Vis Rise | Δ TAN (mg KOH/g oil) | Sludge (mg/100 cc) | Δ Cu (mg/cm$^2$) | Δ Ag (mg/cm$^2$) |
| None | 14.45 | 0.83 | 0.7 | −0.07 | −0.02 |
| 0.05% SOA + 0.02% VL 692 | 10.20 | 0.23 | 1.7 | −0.08 | −0.03 |
| Limits | −5–25 | 3 | 50 | ±0.4 | ±0.2 |

TABLE 4

| | Si Seal Compatibility | |
|---|---|---|
| Load Additives | Δ Swell | % Tensile Strength Loss |
| None | 13.1 | 10.3 |
| 0.1% VL 692 | 3.9 | 84.4 |
| 0.02% VL 692 | 7.8 | 28.7 |
| 0.05% SOA + 0.02% VL 692 | 8.1 | 24.7 |
| Spec | 5–25 | <30 |

What is claimed is:

1. A method for enhancing the load carrying capacity of a turbo oil comprising a major amount of a base stock of a synthetic base oil selected from diesters and polyol ester base oil suitable for use as a turbo oil base stock by adding to said turbo oil base stock a minor amount of load carrying additive comprising a mixture of sulfurized linear $C_{14}$–$C_{18}$ fatty acid, SFA, and an amine phosphate wherein the amine phosphate is monobasic hydrocarbyl amine salt of a diacid phosphate or of mixed mono and diacid phosphates and the sulfurized fatty acid is present in an amount by weight in the range 100 to 1000 ppm and the amine phosphate is present in an amount in the range 50 to 300 ppm based on basestock.

2. The method of claim 1 wherein the base stock is a synthetic polyol ester.

3. The method of claim 1 wherein the SFA is linear $C_{14}$–$C_{18}$ unsaturated or saturated alkyl chains crosslinked by mono-, di- and polysulfides.

4. The method of claim 3 wherein the sulfide bridges are mono- and di-sulfides.

5. The method of claim 3 wherein the weight fraction of sulfur present in SFA ranges from 5 to 15%.

6. The method of claim 3, wherein the SFA is sulfurized oleic acid, SOA.

7. The method of claim 1 wherein the amine phosphate and the SFA are used in a weight ratio of 1:1 to 1:10.

8. The method of claim 1, 2, 3, 4, 5, 6 or 7 wherein the amine phosphate is monobasic hydrocarbyl amine salt of the diacid phosphate.

9. The method of claim 1 wherein the amine phosphate is of the structural formula

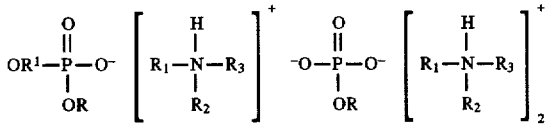

where

R and $R^1$ are the same or different and are $C_1$ to $C_{12}$ linear or branched chain alkyl;

$R_1$ and $R_2$ are H or $C_1$–$C_{12}$ linear or branched chain alkyl;

$R_3$ is $C_4$ to $C_{12}$ linear or branched chain alkyl or aryl-$R_4$ or $R_4$-aryl where $R_4$ is H or $C_1$–$C_{12}$ alkyl, and aryl is $C_6$.

10. The method of claim 9 wherein R and $R^1$ are $C_1$ to $C_6$ alkyl, and $R_1$ and $R_2$ are H or $C_1$–$C_4$, and $R_3$ is aryl-$R_4$ where $R_4$ is linear chain $C_4$–$C_{12}$ alkyl; or $R_3$ is linear or branched $C_8$–$C_{12}$ alkyl, and aryl is $C_6$.

11. The method of claim 1 wherein the amine phosphate and the SFA are used in a weight ratio of 1:1.5 to 1:5.

* * * * *